United States Patent [19]

Imamura et al.

[11] 4,436,026

[45] Mar. 13, 1984

[54] EMPTY CAN CRUSHER

[75] Inventors: Yoshinobu Imamura; Shigeki Kamei, both of Nishinomiya; Tetuo Yamagata, Kobe; Hiroshi Fujii, Amagasaki, all of Japan

[73] Assignee: Hitachi Kiden Kogyo, Ltd., Hyogo, Japan

[21] Appl. No.: 326,748

[22] Filed: Dec. 2, 1981

[30] Foreign Application Priority Data

| | | | |
|---|---|---|---|
| Mar. 6, 1981 | [JP] | Japan | 56-32908 |
| Jun. 29, 1981 | [JP] | Japan | 56-97399[U] |
| Jun. 29, 1981 | [JP] | Japan | 56-97400[U] |
| Jun. 29, 1981 | [JP] | Japan | 56-97401[U] |

[51] Int. Cl.[3] ..... B30B 9/32

[52] U.S. Cl. ..... 100/45; 100/49; 100/91; 100/215; 100/218; 100/266; 100/295; 100/902; 209/38; 221/301

[58] Field of Search ..... 100/902, 215, 49, 91, 100/266, 256, 50, 295, 218, 45; 209/38; 221/301, 295; 335/64, 189

[56] References Cited

U.S. PATENT DOCUMENTS

| | | | |
|---|---|---|---|
| 2,665,345 | 1/1954 | Burton | 335/64 |
| 2,956,660 | 10/1960 | Nordquist | 221/301 |
| 3,517,607 | 6/1970 | Keagle | 100/49 |
| 3,857,334 | 12/1974 | Arp | 100/215 |
| 3,907,087 | 9/1975 | Tanaka | 100/215 |
| 4,265,170 | 5/1981 | Schulze | 100/91 |

FOREIGN PATENT DOCUMENTS

| | | | |
|---|---|---|---|
| 52-8683 | 1/1977 | Japan | 100/902 |
| 56-14097 | 2/1981 | Japan | 100/91 |
| 1257394 | 12/1971 | United Kingdom | 100/902 |

*Primary Examiner*—Billy J. Wilhite

*Attorney, Agent, or Firm*—Wenderoth, Lind & Ponack

[57] ABSTRACT

An empty can crusher for crushing and flattening empty cans, comprising an inlet, a chute, a stopper device, a pressing device and a forked chute. Empty cans supplied in the crusher are crushed and flattened by the pressing device and are sorted into aluminium cans and steel cans by means of a magnet embedded in the pressing device, which fall down into respective receptacles through the forked chute.

11 Claims, 12 Drawing Figures

5
2
6
8
III
III
7
4
1
T1
T2

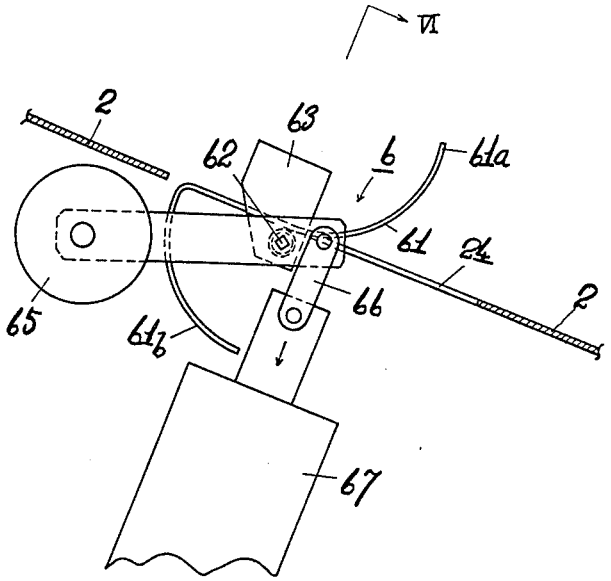
Fig. 6
Fig. 7
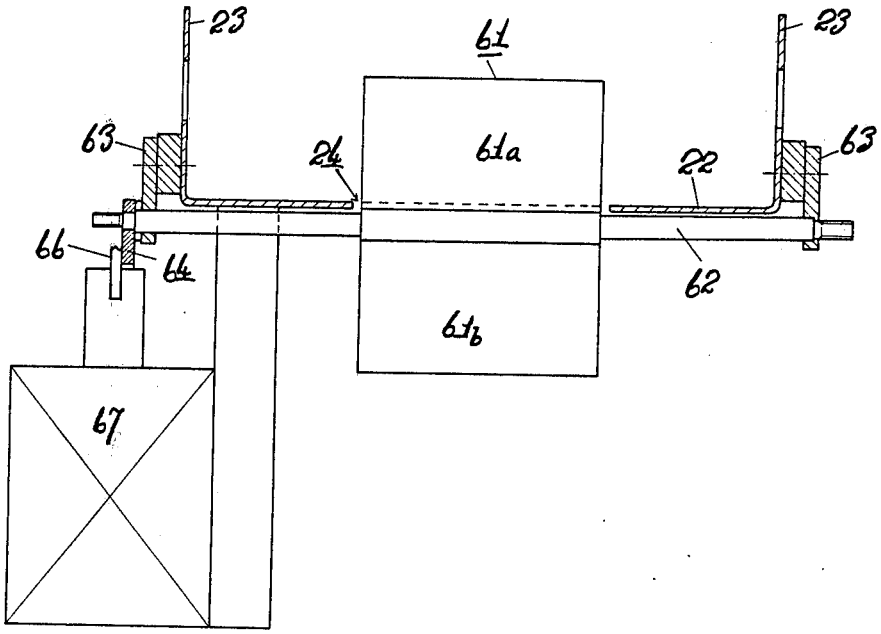

EMPTY CAN CRUSHER

This invention relates to an empty can crusher which crushes and flattens empty beer cans, empty soft drink cans or the like and sorts them according to can material and then removes them from the crusher.

As canned beer, canned soft drinks or the like are easy to carry and handle, they have been used increasingly in place of bottled ones. However, the trouble is that often such cans, when emptied, are thrown away indiscriminantly. In order to prevent such trouble, it is usual that an empty can receptacle is placed beside the vending machine or beside the counter of the shop where the cans are sold but such a receptacle is not very large in holding capacity and is quickly filled up, with the result that empty cans overflow the receptacle and lay scattered on the floor, road, etc. Also, in order to collect many scattered empty cans requires much manual labor. On the other hand, it costs fairly much to carry empty cans collected in each receptacle to a dump and it is a fact that makers and retail distributors pay little attention to the collection of empty cans thrown away everywhere. Thus, the problem of so-called "empty can pollution" has been raised in cities and at places popular with sight-seers.

The empty can crusher according to the present invention is intended for eliminating such "empty can pollution". The nature and advantages of the present invention will be understood more clearly from the following description made with reference to the accompanying drawings, in which:

FIG. 6 is an enlarged view of a stopper device;

FIG. 7 is a cross sectional view, taken along line VI—VI in FIG. 6 and looking in the directions of the arrows;

Figure 1:
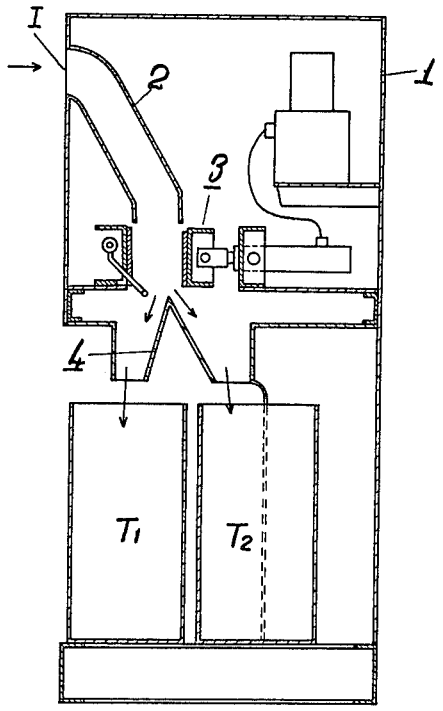
FIG. 1 is a block diagram showing the principle of the empty can crusher according to the present invention.

Referring to FIG. 1, numeral 1 is a main body of the empty can crusher. Provided at the upper part of the main body 1 is an inlet I through which empty cans are thrown into the main body 1. A shutter is provided at the inlet I. A pressing device 3 which flattens empty cans is provided at the lower end of a chute 2 which is connected to the inlet I. Arranged below the pressing device which crushes empty cans by a back pressure plate and a pressing plate which is moved by a cylinder, is a forked sorting chute. By the action of a magnet fitted in the pressing device, pressed empty cans are sorted automatically into aluminum cans and steel cans.

Figure 2:
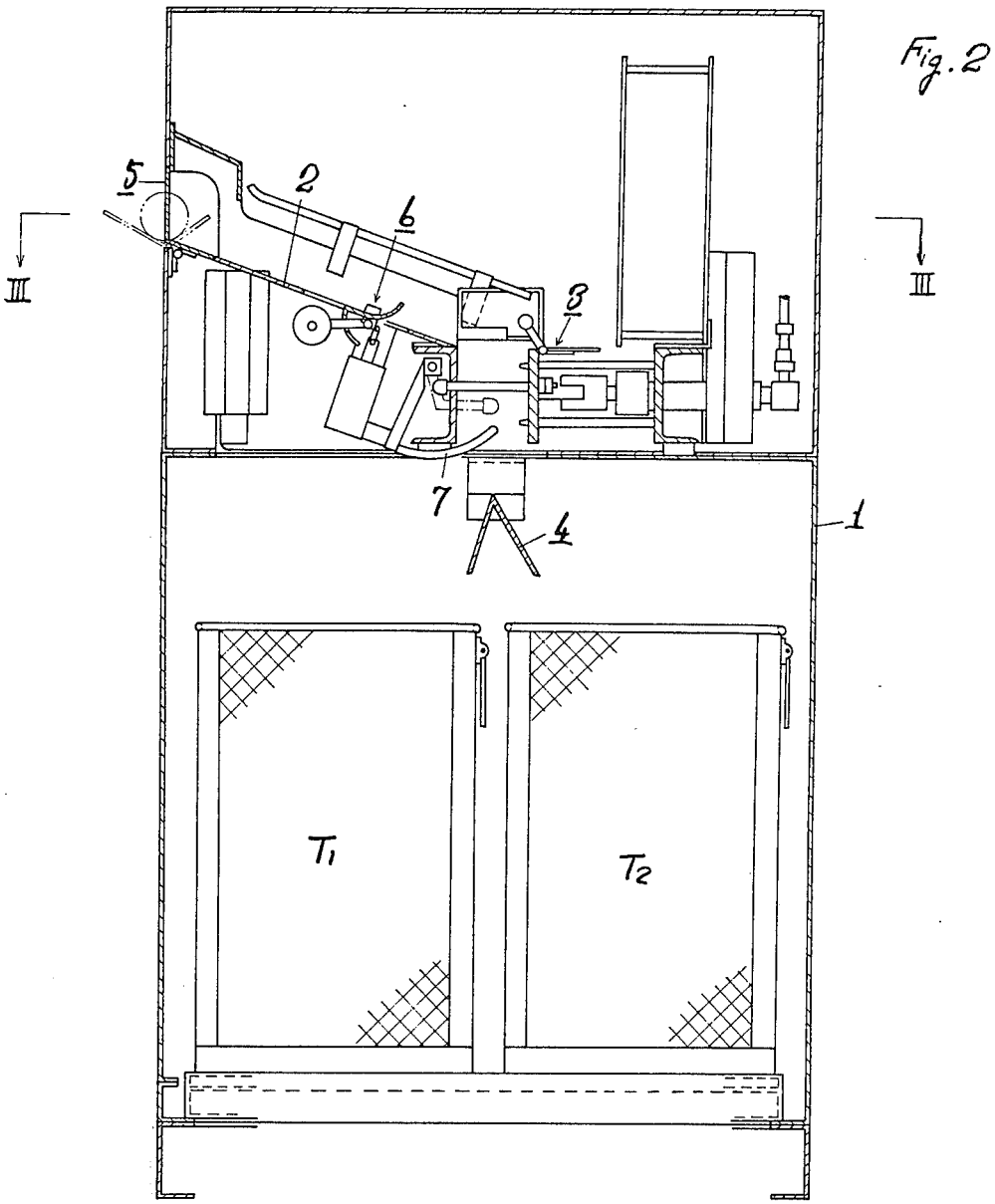
FIG. 2 is a longitudinal sectional view of an embodiment of the present invention.
Figure 3:
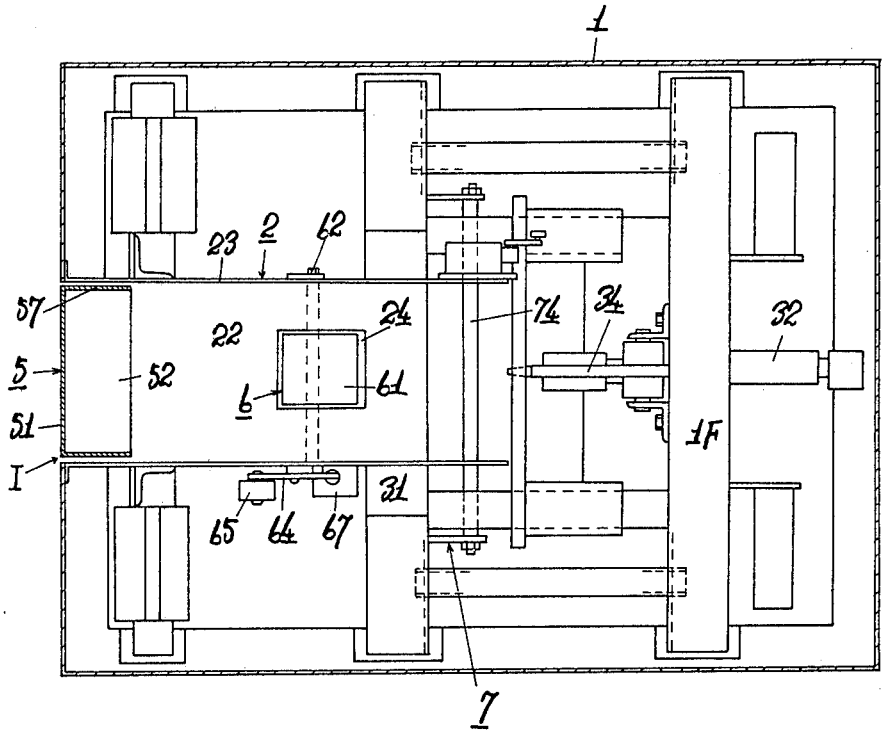
FIG. 3 is a transverse cross-sectional view, taken along line III—III in FIG. 2.

FIG. 2 and FIG. 3 show respectively an outline of the empty can crusher according to the present invention. Details of the empty can crusher are explained below.

Figure 5:
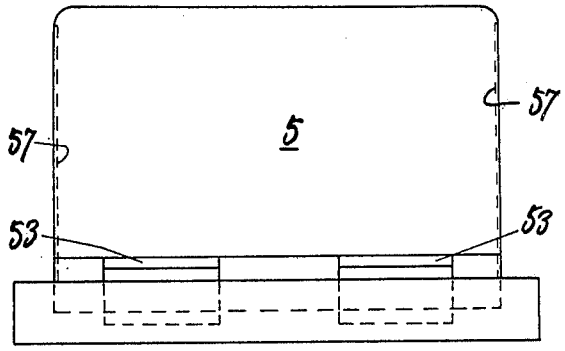
FIG. 5 is a front view of the inlet shown in FIG. 4.
Figure 4:
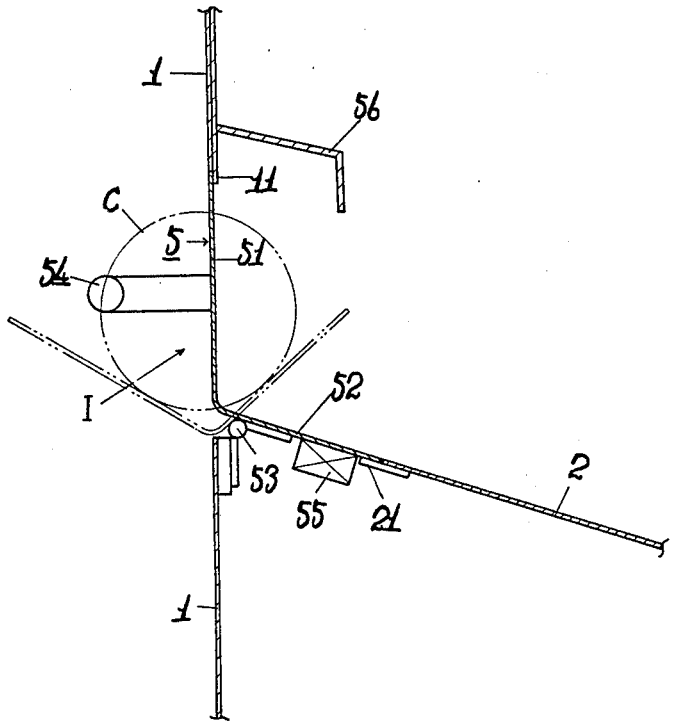
FIG. 4 is an enlarged detail cross-sectional view of the inlet.

A shutter 5 provided at the inlet of the main body in such a fashion that it can be opened and closed (shown in detail in FIG. 4 and FIG. 5) is made of a plate having the width equal to or preferably larger than the full length of an empty can to be crushed. This plate is bent in L-shape to form a lid piece 51 and a bottom piece 52. The shutter 5 is pivotally secured to the main body 1 at the uppermost bottom part of the chute 2 by means of a hinge member 53. The lid piece 51 of the shutter 5 should be of such size that it shuts the inlet I when the shutter 5 is closed. Preferably, in order to keep the inlet I shut while the shutter is closed, it is so adapted that the upper part of the lid piece 51 contacts with a stopper piece 11 provided on the side of the main body 1 and the bottom piece 52 contacts partly with a stopper piece 21 provided on the side of the chute 2. For facilitating opening and closing of the shutter 5, a handle 54 is fixed to the outer side of the lid piece 51. In order to keep the shuter closed or in order to make the shutter easy to close, a weight 55 is provided at the undersurface of the bottom piece 52. By the action of this weight 55 the shutter is kept closed. It is so adapted that when the inlet I is opened by pulling the handle 54 of the shutter 5, the bottom piece 52 of the shutter 5 jumps above the level of the bottom surface of the chute 2 and when an empty can is inserted into the inlet with its bottom part or its top part frontward in the horizontal direction, insertion of the empty can is hindered by both a backboard 56 at the back of the inlet I and the bottom piece 52 which has jumped up and thus an empty can is allowed to slip in the chute 2 only when it is inserted into the inlet I sideways and horizontally. The size of the inlet, the shape and the size of the shutter, the shape and the installing position of the inlet backboard, etc. are so designed that an empty can can be slipped in the inlet only when it is inserted in the inlet sideways and horizontally.

Provided on both sides of the shutter 5 are side plates 57 by which the empty can is to be received in the opened shutter or <-shape only when it is inserted sideways and horizontally. By closing the shuter 5, an empty can received in the shutter of <-shape rolls down the chute when the bottom piece 52 of the shutter coincides with the bottom surface of the chute at its extension line, and is supplied to the crushing device, where the desired crushing is effected.

The chute 2 can have either a steep angle of inclination or a gentle angle of inclination as shown in FIG. 1 and FIG. 2. It is so adapted that empty cans inserted in the inlet I after the shutter 5 is opened roll down the chute accurately and are led to a stopper device and a pressing device. The chute 2 is of square trough shape, having a bottom piece 22 and side pieces 23 on both sides of the bottom piece 22. Preferably, it should be formed by bending a single plate material and its bottom piece should have an inclined flat surface so that empty cans easily roll down thereon.

A stopper device 6 is provided at the intermediate position of the chute 2 as best shown in FIG. 6 and FIG. 7. A window hole 24 is made in the bottom piece 22 of the chute and a stopper piece 61 of inflexed Z-shape is locked in the hole 24 and is provided swingably at the chute 2 by means of an axle 62. The stopper piece 61 is made of sash-like plate which is bent in inflexed Z-shape and is adapted to swing in such a manner that when its lower end side projects above the chute bottom surface, its upper end side positions below the chute bottom surface, namely, the stopper piece 61 swings in such a fashion that it always projects above the chute bottom suface at either one of the lower end side 61*b* and the upper end side 61*a*, whereby an inserted empty can is stopped by either one of the upper end side 61*a* and the lower end side 61*b* of the stopper piece 61. A stopper swinging device is provided at one end or at both ends of the axle 62 which supports the chute by means of a bearing 63. A part of a link 64 is secured to one end of the axle 62 so that the link 64 revolves with the axle 62 as its rotational center. Secured pivotally to one end of the link 64 is a weight 65 which forces the lower end side 61*b* of the stopper piece 61 to project above the chute bottom surface, and secured pivotally to the other end of the link 64 is one end of a link 66 by means of a pin. The lower end of the link 66 is secured pivotally to the main body 1 or to an electromagnet 67 provided in the main body 1 or on the side of this chute 2. An electric circuit is so arranged that when a photoelectric switch, a limit switch or the like detects that an empty can is supported by the lower end side 61*b* of the stopper piece or when it detects that a pressing device (the following process) is empty and an empty can was put in and held by the lower end side 61*b*, the electromagnet is operated automatically.

Figure 8:
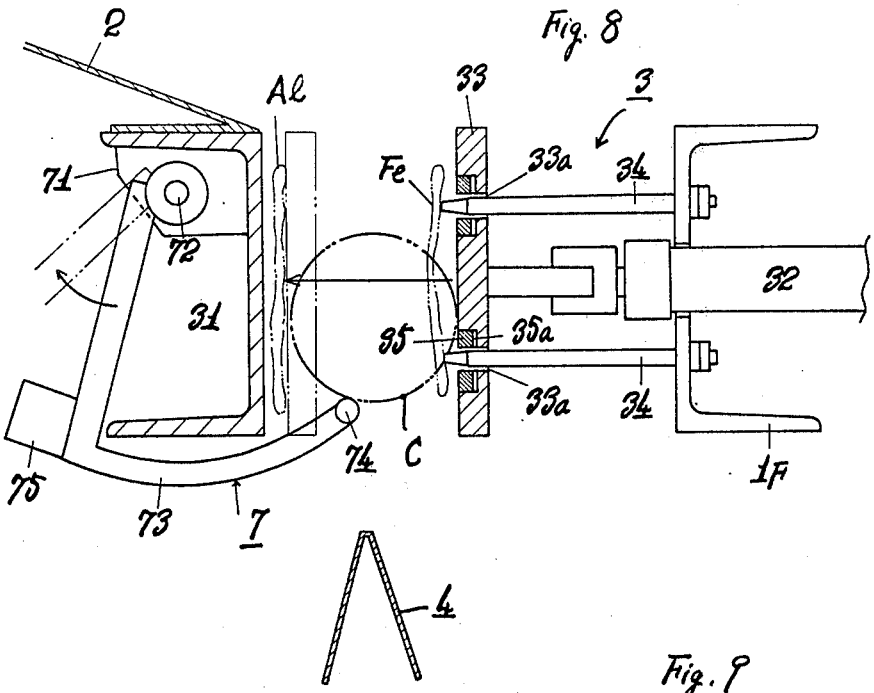
FIG. 8 is a detailed vertical sectional view of an empty can pressing device.
Figure 9:
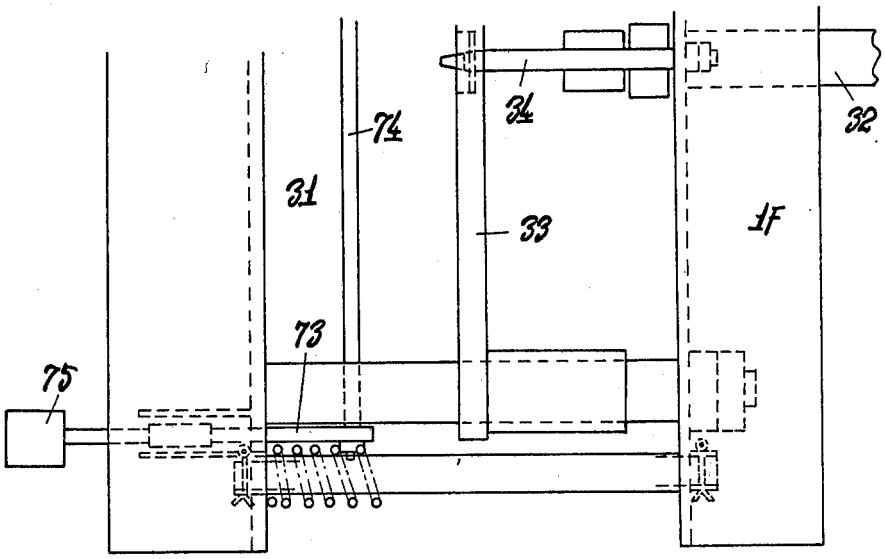
FIG. 9 is a plan view of the empty can pressing device shown in FIG. 8.

The pressing device 3 provided at the lower end of the chute 2 is shown in FIG. 8 and FIG. 9. This pressing device comprises a back pressure plate 31 provided at the lower end of the chute 2 and a pressing plate 33 which slides in the directions toward and away from the opposing back pressure plate 31 by means of a hydraulic cylinder 32. The pressing plate 33 is secured to a top end of the hydraulic cylinder 32. At least one kick-out pin 34 is provided protrudingly at a frame 1F of the main body 1. This kick-out pin 34 is so adapted that when the pressing plate moves back and is away from the back pressure plate to the maximum, it passes through a pin hole 33*a* made in the pressing plate 33 and projects slightly toward the back pressure plate. A magnet 35 is locked in the circumference of the pin hole 33*a* at the side thereof closest to the back pressure plate. The magnet is locked in such a manner that the outer circumference of the pin hole of the pressing plate has a concavity and a rubber plate 35*a* is inserted in this concavity and then the magnet 35 is locked in and secured in the concavity. Preferably, an adhesive is used to ensure perfect fitting of the magnet 35.

Figure 10:
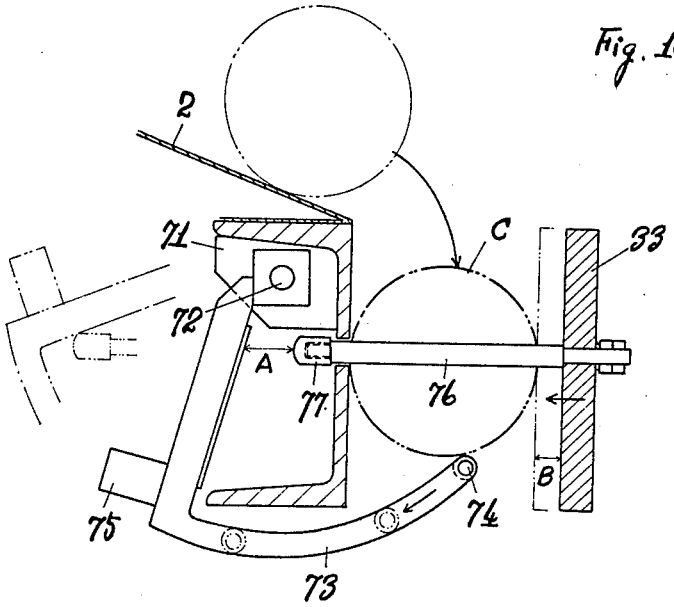
FIG. 10 is a detailed view of an empty can supporting device.

In order to prevent an empty can which has rolled down the chute from falling off the pressing device before it is crushed, an empty can supporting device 7 is provided on the side of the back pressure plate as shown in FIG. 8, FIG. 9 and FIG. 10. This empty can supporting device 7 comprises a pair of swing arms 73 of L-shape pivotally secured, by means of an axle 72, to a bracket 71 which is provided protrudingly at the back pressure plate or the frame fixing the back pressure plate. This pair of swing arms 73 oppose each other with a space larger than the full length of an empty can therebeween. Opposing swing arms 73 are connected by an empty can support rod 74. A weight 75 is mounted on one part of the swing arm 73 and by the action of this weight 75 the top end of the swing arms 73 is projected toward the pressing plate of the pressing device and thus the empty can support rod 74 supports the lower part of an empty can C between the pressing plate 33 and the back pressure plate 31. As there is a possibility that the can support rod 74 at the top end of the swing arms 73 can be damaged when an empty can is crushed, when the pressing plate 33 advances toward the back pressure plate 31 and an empty can is held between both plates, the swing arms 73 are forced to move back so that the empty can support rod 74 is moved back from the empty can being crushed. This action is performed by a push rod 76 provided protrudingly on one of each side of the pressing plate 33 at such a position that it does not hinder the empty can crushing process. The top end of this push rod 76 is passed through the back pressure plate 31 and is opposed to one side of the swing arms 73 with the desired space A therebetween. This space A should be equal to or slightly larger than space B which is the distance between the pressing plate 33 at its fully retreated position and that at its position when it is touching the outer circumference of an empty can C (FIG. 10).

A sorting chute 4 is arranged below the pressing device 3. At this assorting chute 4, crushed empty cans are classified into aluminum cans and steel cans, which fall down into receptacles T1 and T2 respectively and are accumulated there.

When the shutter 5 at the inlet I is opened, an empty can C is thrown in sideways and horizontally and the shutter is closed, the empty can rolls down on the bottom piece of the shutter and further on the inclined chute 2. Then, when the rolling empty can is stopped at the stopper device 6, the empty can is sensed by a photoelectric switch, a limit switch or the like, whereupon the electromagnet turns "ON" and pulls down the link 66, with the result that the link 64 revolves around the axle 62, against the gravitational force of the weight 65. At this time, the stopper piece 61 which is secured to the axle 62 swings and its lower end descends, whereupon the empty can stopper at the lower side of the stopper rolls down the chute 2 and is led to the pressing device, where the desired crushing of empty cans is effected. When the stopper swings, while its lower end descends, its upper end projects above the chute, whereby the next empty can is stopped by the upper end side 61*a* of the stopper. Thus, empty cans are regularly supplied to the pressing device one by one.

When the electromagnet is turned "OFF", the stopper is restored to the original state by the action of the weight 65, whereby a foremost empty can on the chute falls down from the upper end side of the stopper to the lower end side and is stopped there. This action is repeated and thus empty cans are supplied intermittently one by one.

Empty cans are supplied from the stopper device 6 to the pressing device one by one. At this time, the pressing plate moves away from the back pressure plate and an empty can is placed on the empty can support rod 74 projecting from the side of the back pressure plate. Then, a detector (not shown in the drawings) conforms that an empty can has been fed in the pressing device and the pressing plate is advanced toward the back pressure plate by driving the hydraulic cylinder 32. At this time, the empty can is held between the back pressure plate and the pressing plate. When the pressing plate advances further, the empty can is crushed and flattened between the back pressure plate and the pressing plate and the swing arm is pushed by the push rod, whereby the empty can support rod moves back to the position below the back pressure plate at a speed faster than the advancing speed of the pressing plate.

When the pressing plate advances still further, the empty can is crushed into the desired flat shape between the back pressure plate and the pressing plate. Since empty cans thrown in from the inlet I are either aluminum cans or steel cans, when the pressing plate moves back by means of the hydraulic cylinder after the crushing process, an aluminum can A1 falls down by its own weight upon releasing of pressing between the back pressure plate and the pressing plate. At this time, as an angle-shaped sorting chute 4 is positioned below the center of the distance between the back pressure plate and the pressing plate, the aluminum can falls down toward the left side of the chute and falls into the aluminum can receptacle T1. In the case of steel cans Fe, when the pressing plate moves back a steel can is attracted by the magnet embedded in the pressing plate and does not fall down when the back pressure plate and the pressing plate are separated. The steel can is moved laterally by the moving back of the pressing plate and when the pressing plate returns to its waiting position, the top end of the kick-out pin projects from the pin hole, with the result that the force of the magnet is broken and the steel can falls down by its own weight. At this time, since the falling steel can is on the rightward side of the sorting chute 4, it falls down into the steel can receptacle T2. Thus, crushed empty cans are sorted automatically according to the quality of can material. When the pressing plate begins to move back, the push rod which was pushing the empty can supporting rod also moves back with the pressing plate and thus the supporting rod is restored to its original state by the action of the weight annexed thereto. An adjusting cap 77 is screwed to the top end of the push rod for making the space A adjustable.

Figure 11:
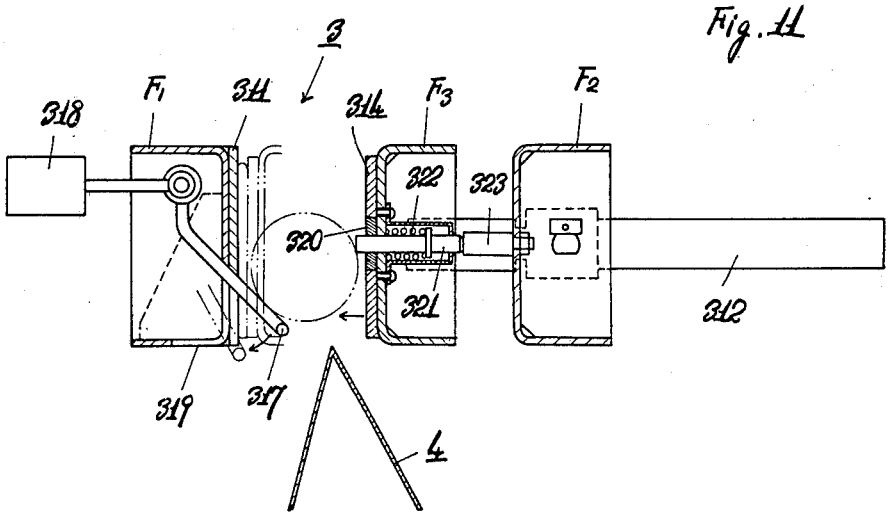
FIG. 11 is a longitudinal sectional view of another embodiment of the empty can pressing device.
Figure 12:
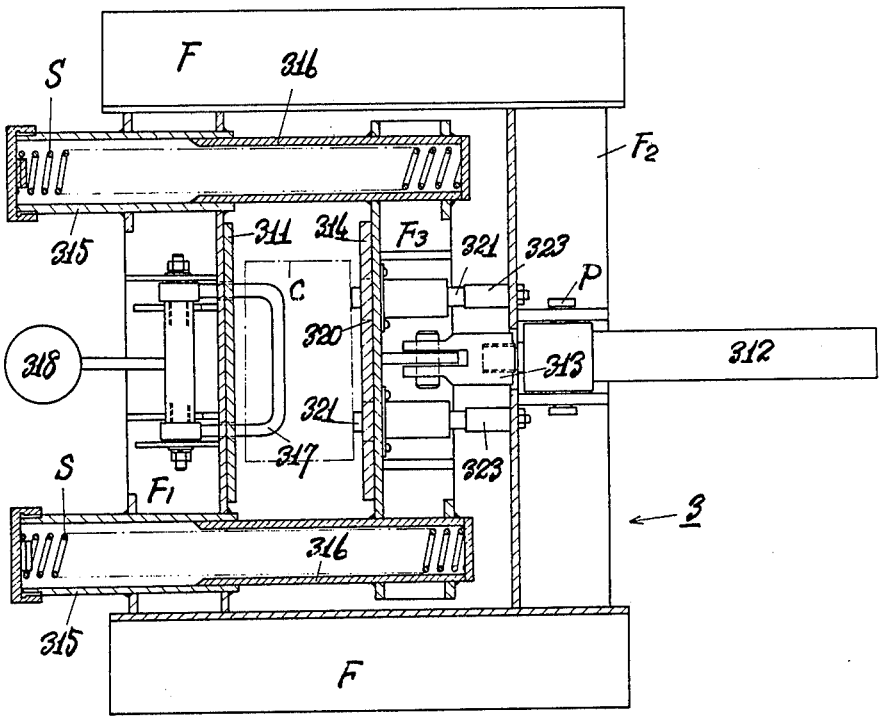
FIG. 12 is a cross-sectional plan view of the empty can pressing device shown in FIG. 11.

FIG. 11 and FIG. 12 show a different embodiment of the pressing device. In this embodiment, a back pressure plate supporting frame F1 and a cylinder supporting frame F2 are provided oppositely to a fixed frame F secured to the main body 1. A back pressure plate 311 is provided at the surface of the back pressure plate supporting frame F1 opposing the pressing plate and a hydraulic cylinder 312 is supported by the cylinder supporting frame F2 by means of a pin P. A movable frame F3 is provided opposite the back pressure plate 311 through the medium of a metal fitting 313 fixed to the top end of the rod of the hydraulic cylinder 312 and a pressing plate 314 is provided integrally with the front face of the frame F3. Empty cans are crushed between the opposing pressing plate 314 and back pressure plate 311 by the operation of the hydraulic cylinder. A cylindrical spring holder 315 is fixed to one side or both sides of the back pressure plate supporting frame F1 opposite the movable frame F3 and a cylindrical spring holder 316 is provided at the movable frame F3 in such a fashion that it opposes the cylindrical spring holder 315. Both spring holders 315, 316 are interlocked slidably and coiled springs S for restoring the cylinder are inserted in the spring holders. This arrangement is so adapted that before the cylinder begins to work a gap is provided between the back pressure plate 311 and the pressing plate 314 in which an empty can is insertable. A swingable empty can supporter 317 is provided on the side of the back pressure plate supporting frame so that an empty can supplied from the chute does not fall downward before it is crushed between the pressing plate and the back pressure plate. The lower part of this empty can supporter is horizontal and projects from the back pressure plate by the length necessary to support the bottom part (lower part) of an empty can between the pressing plate and the back pressure plate. The upper part of the empty can supporter is swingably secured to the back pressure plate supporting frame F1 by means of a pin. A balance weight 318 is provided at the top end of the supporter which stabilizes the position of the empty can supporter so as to project from the back pressure plate to the predetermined extent, unless it is affected by external force. The swinging angle of this empty can supporter is determined by the length of a through groove 319 bored in the back pressure plate supporting frame or by another stopper.

In crushing empty cans by an empty can crusher of the above-mentioned construction, if an empty can is thrown in the inlet I, the empty can rolls down on the chute 2 and its lower part is supported by the empty can supporter 317 of the opened pressing device 3 and the empty can is positioned between the pressing plate 314 and the back pressure plate 311. Upon detecting of the existence of an empty can in the pressing device 3 by a detector, a hydraulic pump in the main body operates to supply pressurized working oil to the hydraulic cylinder 312 of the pressing device, whereupon the movable frame F3 advances toward the back pressure plate side by means of the hydraulic cylinder. At this time, springs S in the cylindrical spring holders yield by the action of the hydraulic cylinder and the spring holder 316 merges into the spring holder 315 and by the sliding of these two spring holders, the movable frame advances as it is keeping parallel with the back pressure plate, whereby an empty can is pressed and crushed between the fixed back pressure plate and the advancing pressing plate. At the same time, the top end of the empty can supporter is pushed by the advance of the pressing plate and the supporter is caused to swing toward the back pressure side against the projecting force of the balance weight, therefore not interfering with the crushing of empty cans. The empty can in the crushing process does not fall down because it is held firmly between the pressing plate and the back pressure plate. Afer the crushing is complete, if oil feeding to the hydraulic cylinder is suspended, the movable frame and the pressing plate are caused to move back by the action of springs S and are restored to their original state. At this time, the crushed empty can shape falls. At this time, the empty can supporter is also restored to its original state by the action of the balance weight, but since the crushed and flattened empty can is not supported by the empty can supporter, it falls downward even though the empty can supporter is restored to its original state with the backward movement of the pressing plate.

In sorting empty cans according to the quality of can material, at least one magnet 320 which attracts the crushed empty can is provided at the pressing plate and at least one kick-out pin 321 is provided at the movable frame so that a crushed empty can drawn to the magnet 320 is separated forcibly when the pressing plate is restored to its original state. This kick-out pin 321 is provided so as to slide through the movable frame retreat from the front of the pressing plate. The kick-out pin 321 is coupled with a restoring spring 322 so that this pin is urged to disappear from the surface of the pressing plate. A striker 323 protrudes at the cylinder supporting frame F2 in such a fashion that it opposes the rear end of the kick-out pin. The length of the striker 323 and the kick-out pin 321 is so determined that when the pressing plate moves back and restores to its waiting position, the rear end of the kick-out pin is kicked out by the striker and the top end of the pin projects slightly from the surface of the pressing plate 314, whereby the crushed empty can is forcibly separated from the magnet.

The stopping of the hydraulic cylinder upon crushing of an empty can is effected by adjusting the stroke of the hydraulic cylinder or by stopping the hydraulic pump by detecting the pressing force of the pressing plate.

The magnet can be either a permanent magnet or an electromagnet. In the case of the electromagnet, a crushed empty can can be released from the pressing plate simply by releasing excitation of the electromagnet, instead of utilizing a kicking out device.

According to the present invention, since a chute bent in an L-shape is provided at the inlet, an empty can is allowed to be thrown in only when it is put in horizontally and sideways. Therefore, the empty cans cannot stop up the feeding chute. Since an empty can cannot be fed to the crusher in a longitudinal direction with its top part or its bottom part frontward, it can be crushed into a flat shape accurately. Since the crusher has a stopper device which supplies empty cans thrown in through the inlet to the pressing device on by one, there is no fear that two or more empty cans will be supplied simultaneously to the pressing device, and therefore empty cans are crushed one by one accurately, free from the trouble with the crusher itself.

What is claimed is:

1. An apparatus for crushing and sorting empty cans, comprising:

a main body frame;

a pressing device, said pressing device including a vertically extending back pressure plate, a vertically extending pressing plate horizontally spaced from and confronting said back pressure plate, and means, including a hydraulic cylinder, for linearly moving said pressing plate horizontally toward and away from said back pressure plate between a first position horizontally spaced from said back pressure plate a distance greater than the diameter of the empty can to be crushed and a second position horizontally spaced from said back pressure plate a distance substantially less than the diameter of the empty can to be crushed;

an empty can supporting bar pivotally mounted to said frame at said back pressure plate for vertically supporting the empty can between said back pressure plate and said pressing plate during movement of said pressing plate toward said back pressure plate;

a magnet embedded in said pressing plate for holding a magnetically attractive crushed empty can to said pressure plate when said pressing plate is moved away from said back pressure plate;

means for separating the magnetically attractive crushed empty can from said pressing plate after said pressure plate has moved away from said back pressure plate to a third position whereby the magnetically attractive crushed empty can falls downward under the influence of gravity;

an empty chute for delivering an empty can to a position between said back pressure plate and said pressing plate when said pressing plate is in said first position; and a forked sorting chute located in said main body frame below said pressing device defining a first path below said first position and a second path below said third position, said forked sorting chute respectively directing magnetically non-attractive and magnetically attractive crushed empty cans falling from said pressing plate to separate locations along first and second paths.

2. An apparatus as in claim 1, wherein said magnet comprises an electromagnet, said separating means comprising means for energizing and deenergizing said electromagnet.

3. An apparatus as in claim 1, wherein said magnet comprises a permanent magnet, said separating means comprising a kick-out pin slidable relative to said pressing plate for forcibly disengaging the magnetically attractive crushed empty can from said pressing plate against the magnetic force of said permanent magnet.

4. An apparatus as in claim 1, further comprising first and second receptacles located within said frame for respectively receiving said magnetically attractive and magnetically non-attractive crushed empty cans.

5. An apparatus as in claim 1, wherein said supporting bar is pivotably mounted to said frame behind said back pressure plate, said apparatus further comprising a push rod fixed to said pressure plate and extendable rearward of said back pressure plate into contact with said supporting bar rearward of said back pressure plate so as to pivot said supporting bar rearward of said back pressure plate and out of engagement with the empty can as said pressing plate moves toward said back pressure plate while crushing the empty can between said pressing plate and back pressure plate.

6. An apparatus for crushing cans comprising:

a main body frame having an inlet opening;

means for crushing empty cans inserted into said main body frame through said inlet opening;

a chute for carrying empty cans to said crushing means from said inlet opening; and a shutter pivotally mounted to said chute at said inlet opening, said shutter including a lid piece and a bottom piece together having an L-shape cross section and having opposing vertically extending side plates on both sides thereof;

said frame including a backboard extending inward and downward at the back of said inlet opening so as to block entry of the empty cans top end or bottom end first.

7. An apparatus as in claim 6, wherein said frame has an inlet which is substantially flush with said lid piece of said shutter when said shutter is closed, said shutter having a handle extending forward of said lid piece such that only said handle protrudes from said frame when said shutter is closed.

8. An apparatus for crushing and sorting empty cans, comprising:

a frame having an inlet opening;

a pressing device, said pressing device including a back pressure plate fixed to said frame and a pressing plate horizontally slidable toward and away from said back pressure plate and means, including a hydraulic cylinder, for hydraulically moving said pressing plate horizontally toward and away from said back pressure plate;

an entry chute for supplying one-by-one empty cans inserted horizontally and sideways into said inlet opening to said pressing device between said back pressure plate and said pressing plate;

a magnet provided in the surface of said pressing plate facing said back pressure plate for holding a magnetically attractive empty can thereto;

a horizontally extending kick-out pin fixed to said frame behind said pressing plate so as to extend through said pressing plate in sliding relation thereto when said pressing plate is moved away from said back pressure plate, whereby a crushed magnetically attractive empty can held to said pressing plate by said magnet is forcibly disengaged therefrom by contact with said kick-out pin; and a sorting chute below and intermediate of said back pressure plate for separating magnetically attractive and magnetically non-attractive crushed empty cans.

9. An apparatus for crushing empty cans, comprising:

a frame;

a back pressure plate fixed to said frame;

a pressing plate movable horizontally toward said back pressure plate to crush an empty can between said back pressure plate and said pressing plate, and movable horizontally away from said back pressure plate after the empty can has been crushed;

means, including a swing arm structure having an end normally between said back pressure plate and said pressing plate pivotally mounted to said frame, for vertically supporting from below the empty can;

a weight fixed to said swing arm structure so as to bias said end upward and resist pivotal movement of said end behind said back pressure plate;

and means, including a push rod mounted to said pressing plate so as to push said swing arm in pivotal movement when said pressing plate moves toward said back pressure plate, for pivoting said swing arm when said pressing plate moves toward said back pressure plate such that the speed of said end of said swing arm in the direction of movement of said pressing plate exceeds the speed of said pressing plate.

10. An apparatus as in claim 9, wherein said swing arm structure includes two generally L-shaped swing arms pivotally mounted to said frame behind said back pressure plate and a support rod extending horizontally between said swing arms at said end.

11. An apparatus for crushing and sorting empty cans, comprising:

a back pressure plate;

a pressing plate having at least one hole therein, reciprocally horizontally movable toward and away from said back pressure plate;

a feeding chute for directing an empty can between said back pressure plate and said pressing plate;

means for supporting only one empty can between said pressing plate and said back pressure plate until engaged by said pressing plate while moving toward said back pressure plate; and means for sorting crushed magnetically attractive empty cans and crushed magnetically non-attractive cans, including a permanent magnet in said pressing plate and at least one kick-out pin having a first end located outside the space between said pressing plate and said back pressure plate, and having a second end which passes through said pressing plate into the space between said pressing plate and said back pressure plate while said pressing plate is moving away from said back pressure plate so as to engage, and forcibly disengage from said pressing plate, any magnetically attractive empty can held thereto by said permanent magnet.

* * * * *